US005207128A

United States Patent [19]

Albright

[11] Patent Number: 5,207,128

[45] Date of Patent: May 4, 1993

[54] TONG WITH FLOATING JAWS

[75] Inventor: Stephen L. Albright, Houston, Tex.

[73] Assignee: Weatherford-Petco, Inc., Houston, Tex.

[21] Appl. No.: 855,561

[22] Filed: Mar. 23, 1992

[51] Int. Cl.[5] ..... B25B 13/50

[52] U.S. Cl. ..... 81/57.18; 81/57.14; 81/57.2; 81/57.21

[58] Field of Search ..... 81/57.14, 57.15, 57.16, 81/57.18, 57.2, 57.21, 57.33, 57.34

[56] References Cited

U.S. PATENT DOCUMENTS

| | | | |
|---|---|---|---|
| 2,618,468 | 11/1952 | Lundeen | 255/35 |
| 2,989,880 | 6/1961 | Hesser et al. | 81/53 |
| 3,180,186 | 4/1965 | Catland | 81/57.18 |
| 3,380,323 | 2/1966 | Campbell | 81/57.34 |
| 3,589,742 | 6/1971 | Flick | 279/71 |
| 3,635,105 | 1/1972 | Dickmann et al. | 81/57.18 |
| 4,246,809 | 1/1981 | Keast et al. | 81/57.16 |
| 4,250,773 | 2/1981 | Haynes et al. | 81/57.18 |
| 4,297,922 | 11/1981 | Higdon | 81/57.18 |
| 4,346,629 | 8/1982 | Kinzbach | 81/57.2 |
| 4,357,843 | 11/1982 | Peck et al. | 81/57.16 |
| 5,044,232 | 9/1991 | Schulze-Beckinghausen | 81/57.18 |

OTHER PUBLICATIONS

"Hydraulic Power Tongs Operation and Service Instructions," by Eckel Mfg. Co. Inc., 1979.

"Model 4.5–08 Hydraulic Power Tong," Weatherford Power Equipment, 1988.

"Model 4.5 Hydraulic Power Tong," Weatherford Oilfield Power Equipment, 1983.

*Primary Examiner*—D. S. Meislin

*Attorney, Agent, or Firm*—Guy McClung

[57] ABSTRACT

A tong, preferably a power tong, with one or more floating jaws which are releasably retained on and selectively movable with a rotary device; in one aspect the jaws having a compound jaw camming surface with a primary cam action surface, a rest surface, and a fixed positioning surface; and in one aspect such a tong with a releasably jaw urging system for releasably urging the jaws against camming jaw rollers.

5 Claims, 6 Drawing Sheets

TONG WITH FLOATING JAWS

BACKGROUND OF THE INVENTION

1. Field of the Invention

This invention is directed to tongs; in one aspect to a power tong with two or more floating jaws; and in other aspects to a floating tong jaw and other parts of a tong, e.g., a jaw urging system.

2. Description of Related Art

A variety of operations related to drilling a wellbore and to producing oil and other fluids from it involve the threaded connection of tubular members such as casing, drill pipe, tubing or sucker rods. The prior art discloses numerous power operated tongs that are used to impart rotational torque to one tubular to threadedly connect it with another tubular. One type of power tong uses jaws which move into contact with a tubular to grip it. Rotation of a member to which the jaws are connected or with which the jaws co-act results in rotation of the tubular which has been gripped by the jaws. Elementary mechanisms for the transfer of rotative force to a tubular are described in U.S. Pat. No. 4,346,629, co-owned with this application.

One type of prior art power tong has a body, a rotary rotatably mounted in said body, and at least one active jaw which, on rotation of the rotary, is cammed against a cam surface of a cam member which moves the jaw into contact with a pipe which has been positioned in the rotary. The jaw contacts the pipe and grips it for rotation with the rotary.

The camming action is generated by the cam member which is bolted to the rotary and is shaped so that the active jaw will be cammed against the pipe on rotation of the rotary relative to the active jaw in one direction and will be released on rotation of the rotary relative to the active jaw in the opposite direction. In order to reverse the screwing direction of the tong with one active jaw, the active jaw is removed and remounted on the opposite side of the rotary. On rotation of the rotary relative to the active jaw in the opposite direction, the active jaw is cammed against the pipe by a second cam member. This is a time-consuming process and the tong must be removed from the pipe to enable the active jaw to be moved.

One prior art power tong, T, is depicted in FIGS. 1-3. The tong T has a fixed master jaw M pinned to an inner ring, R, and an active jaw, A, also pinned to the inner ring R. The jaws are rotated and activated by the combined action of a rotary gear, G, a brake (not shown) and the cam rollers, C. During makeup operations, a pipe to be turned is first enclosed in the tong and a tong door (not shown) is closed. Then, with the jaws in the makeup position, a control lever is pulled causing the jaws to bite and rotate the pipe. To release the jaws and back off from the pipe, the tong control lever is again moved (e.g., inwardly). During breakout operations, the jaws are placed in the breakout position so that the jaws bite in the reverse direction. The tong control lever is pushed, causing the jaws to bite and rotate the pipe. Finally, the control lever is pulled to release the jaws and back them off the pipe.

As shown in FIGS. 1-3 the jaw-biting action is the result of the rotary gear-cam rollers/jaw-cam surface interaction. When the rotary gear rotates, the rollers roll up onto the jaw cam surface and force the jaws to bite the pipe. Further rotation turns the pipe to make up or break out a joint. To provide the restraint necessary for camming to occur, a brake is applied. The brake induces drag on the inner ring within the tong sufficient to permit the jaw roller to push the jaw into engagement with the pipe. Once the jaw is engaged and power to the rotary is increased, the brake is overcome, allowing the jaws to rotate with the rotary gear.

In order to reverse the direction of the tong T shown in FIGS. 1-3, openings in the rotary and tong body must first be aligned. Then the pins are unscrewed and removed from the master jaw and from the active jaw. The jaws are removed from the inner ring, inverted, and re-positioned on the inner ring. Once the pins are replaced the tong is ready for use in the opposite direction. Typically this takes several minutes for one reversal of direction. This prior art tong and its operation are described in the manual submitted herewith entitled "Model 4.5-08 Hydraulic Power Tong, Weatherford Power Equipment" and in the brochure entitled "Model 4.5 Hydraulic Power Tong." (co-owned with this invention).

Prior art U.S. Pat. No. 5,044,232, co-owned with this application, discloses another tong with a slidable passive jaw and an active jaw. The active jaw has dual cam member surfaces which co-act with rollers to move the active jaw into and out of contact with a pipe. The active jaw is held in place on a jaw assembly by the dual cam members and by a spring which urges the jaw against the rollers. To reverse the direction of this tong a bolt is moved in a slot of the drum that carries the active jaw until it contacts a surface in the rotary. The active jaw does not need to be removed.

Prior art U.S. Pat. No. 5,380,323 discloses a power tong having a housing, an annular rotor carried by the housing, reversible drive means for rotating the rotor in either direction, jaw means mounted on the rotor in such a manner as to permit limited rotation of the rotor relative to the jaw means in either direction, double-acting cam means for closing the jaw means in response to limited rotation of the rotor relative to the jaw means in either direction from a neutral position, braking means for restraining the jaw means upon rotation of the rotor in either direction to actuate the cam means and thus close the jaw means, and spring means for biasing the jaw means open in opposition to the action of the cam means so that the jaw means opens when it is in its neutral position relative to the rotor. The housing, the rotor and the jaw means have registerable radial throats permitting radial insertion of a pipe or rod starting into the jaw means into a position to be gripped by the jaw means upon closing thereof. The double-acting cam means closes the jaw means in response to rotation of the rotor in either direction, as long as the braking means restrains the jaw means in order to permit the rotor to rotate relative to the jaw means in either direction the relative neutral positions of the rotor and the jaw means. The jaws are diametrically opposed and have cam follower rollers mounted on the jaws. The jaws are guided by guide walls on the rotor. A leaf spring urges the jaws against the cam surfaces on the rotor.

There has long been a need for a tong with active jaws which can be easily and efficiently reversed in direction. There has long been a need for such a tong which applies evenly distributed loads to a tubular member. There has long been a need for an effective and efficient floating jaw urging system.

SUMMARY OF THE PRESENT INVENTION

The present invention, in one embodiment, discloses a power tong with a tong body or case; a rotary rotatably mounted in the body; reversible drive apparatus and transmission apparatus for rotating the rotary; at least one jaw and preferably two or more jaws retained in an inner ring and resting on a plate which is secured to the rotary; rollers rotatably mounted on the rotary against which jaw surfaces are cammed to move the jaws with respect to a tubular member to be rotated by the power tong; braking apparatus for inducing drag on the inner ring to produce the jaw camming action; and a holding system for urging the jaws cam surfaces against the rollers.

In one embodiment of the present invention a jaw holding system is employed to urge the jaws against the jaw rollers. In one aspect this holding system has an assembly pivotally mounted to the inner ring with one or more projections that releasbly extend into a jaw slot in a jaw. Springs extending from and connected to the inner ring and connected to the projections hold the jaw against a jaw roller. Movement of a handle connected to the assembly pivots the projections out of the jaw slot (or slots) permitting removal of the jaw from its resting position on the plate bolted to the rotary and from its position within the inner ring. For correct disposition of the jaw on the plate a slot-extension combination can be used, e.g. a slot on the plate and a corresponding extension on the jaw, or vice versa. The jaw holding system can hold the jaw so that the adjacent jaw roller rests on the rest cam surface, e.g. while a pipe is being introduced into the tong.

In one embodiment the braking apparatus includes one or more movable brake button which extend through a plate mounted on the top of the tong and have, preferably, friction surfaces at one end thereof which are urged against the inner ring to produce a desired drag.

In one embodiment each jaw has a compound cam surface which includes: a primary cam surface which, when it co-acts with a jaw roller, results in movement of the jaw to contact the tubular member to be rotated; a rest cam surface at which a roller is located when the jaw is not engaging the tubular member; a plateau cam surface which, when a jaw roller co-acts therewith, provides a fixed known distance between the center of the roller and the center of a pipe to be rotated by the tong; and secondary surfaces at one or both ends of the compound cam surface for contacting a jaw roller and for providing support to the jaw to inhibit or prevent unwanted pivoting of the jaw and to take part of the working load on the jaws during operation.

A tang extension according to one aspect of the invention is provided at one end of the compound cam surfaces to guide jaws properly onto a roller. Dual jaws may have axially offset tangs so that each tang can accomplish its guiding function without interfering with the other tang. In certain embodiments, a stop surface is provided on the jaw, located at a secondary cam surface or at a plateau cam surface, for example, to hold the jaw and prevent it from over-rotating beyond the jaw cam surface. Holes may be provided in the inner ring through which a stop pin is insertable to extend to contact a stop tab or tabs on the rotary. When the stop pin contacts the stop tab, further rotation of the inner ring with respect to the rotary is prevented and the jaws are held centered in a rest position so that a pipe or other tubular can be removed from the tong or inserted into the tong. For rotation in one direction, a pin extends through one hole; for limiting rotation in the other direction, the pin is removed and inserted into another hole to contact another stop tab on the rotary.

If is, therefore, an object of at least certain preferred embodiments of the present invention:

to provide new, useful, unique, efficient, and effective tongs, tong jaw urging systems, and jaws;

to provide such tongs with floating jaws;

to provide tongs with jaws that need not be removed to reverse tong direction of operation;

to provide tongs which distribute loads evenly;

to provide effective floating tong jaws; and to provide an effective holding system for a floating tong jaw.

DESCRIPTION OF EMBODIMENTS PREFERRED AT THE TIME OF FILLING FOR THIS PATENT

Figure 4:
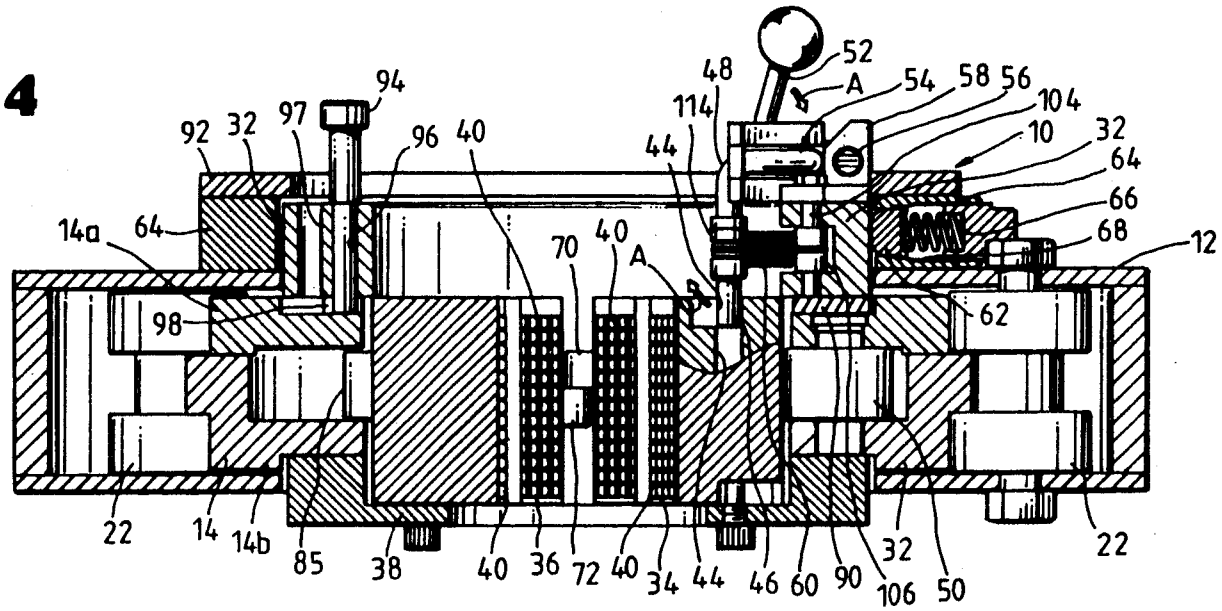
FIG. 4 is a side cross-sectional view of a tong according to the present invention.
Figure 5:
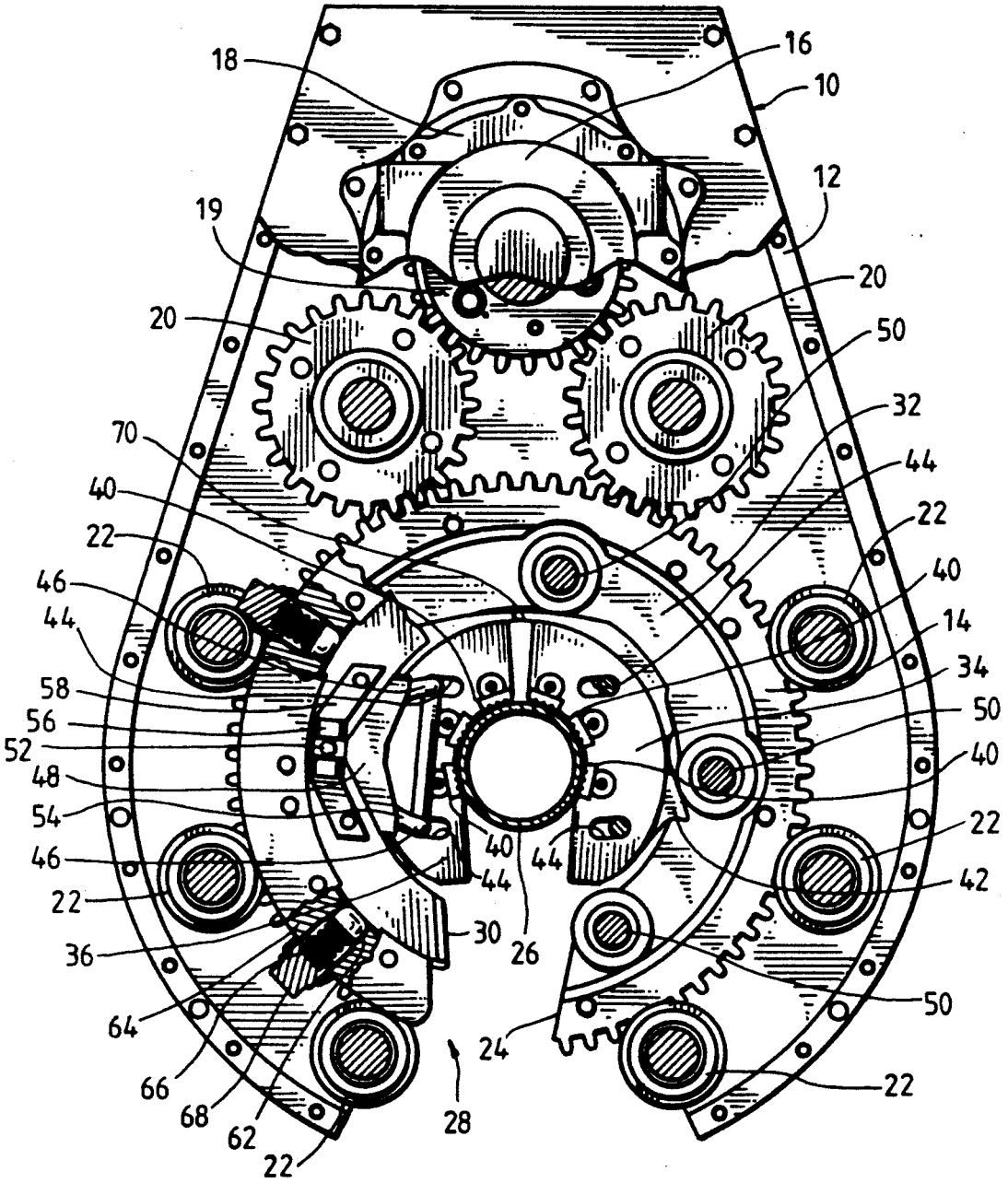
FIG. 5 is a top view, partially cutaway, of the tong of FIG. 4.

Referring now to FIGS. 4 and 5, a tong 10 according to the present invention has a tong case or body 12 within which is rotatably mounted a rotary 14. Power is provided to the rotary by a motor 16 via a transmission 18 with a transmission gear 19 and drive gears 20.

The rotary 14 is mounted on and supported by a plurality of guide rollers 22. The rotary 14 has a throat 24 for receiving a tubular member 26 to be rotated. The throat 24 is alignable with a throat 28 in the case 12 and a throat 30 in an inner ring 32. The inner ring 32 is mounted on the rotary 14. Two jaws 34 and 36 are disposed in the rotary 14 and rest on a plate 38.

Each jaw 34 and 36 has a plurality of dies 40 and a compound cam surface 42. One or more slots 44 in the jaws (two or more preferred) receive one or more projections 46 (two or more preferred) of a jaw urging or holding assembly 48 which urges the jaws against one of a plurality of jaw rollers 50 which are rotatably secured to the rotary 14 (two rollers are not shown in the tong of FIG. 5).

The jaw urging assembly 48 has an upwardly extending handle 52 which is secured to a wishbone member 54 from which project the projections 46. The wishbone member 54 is pivotally connected with a pin 56 to a support bracket 58 so that pivoting of the handle 52 results in the pivoting of the projections 46 out of the slots 44 in the jaws 34 and 36, freeing the jaws for easy removal. Springs 60 connected to the inner ring urge the wishbone member 54 and thereby the jaws 34 and 36 against the jaw rollers 50.

Brake Buttons 62 extend through a plate 64 mounted on the tong case to contact the inner ring 32 to provide a desired drag on the inner ring 32 so that camming of the jaws is initiated when the rotary first begins to rotate; i.e. the inner ring 32 does not immediately begin to rotate with the rotary until the jaws have been correctly cammed into position. A spring 66 mounted in a cylindrical body member 68 urges each brake button 62 against the inner ring 32 with a predetermined frictional force.

Figure 9B:
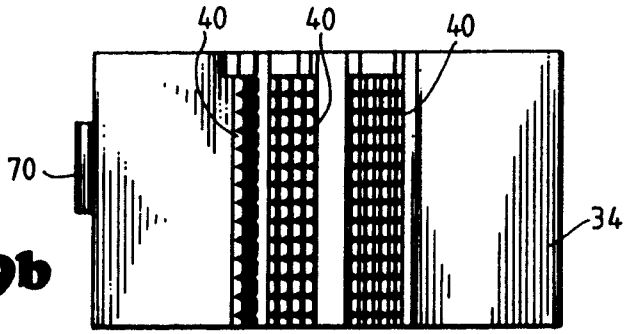
FIG. 9*b* is a side view of the jaw of FIG. 9*a*.
Figure 9A:
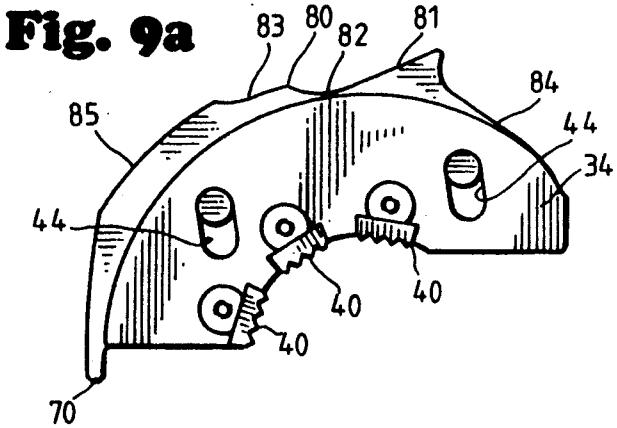
FIG. 9*a* is a top view of a jaw according to this invention.

A tang extension 70 on the jaw 34 overlaps a similar tang extension 72 (see FIG. 4) on the jaw 36. These tang extensions assist in the guiding of the jaws onto the jaw rollers FIGS. 9*a* and 9*b* illustrate the jaw 34 according to the present invention. The jaw 34 has a compound cam surface 80 which has a primary camming surface 81, a rest cam cradle or surface 82, a plateau cam surface 83, a first secondary cam surface 84, and a second secondary cam surface 85.

Figure 6:
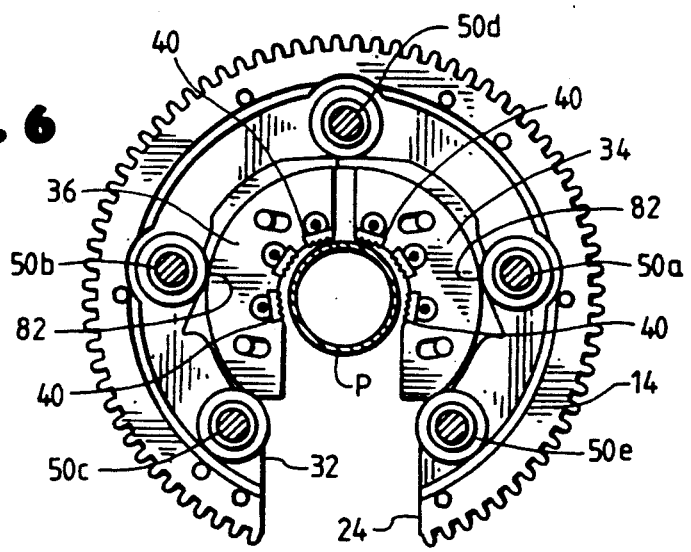
FIG. 6 is partial top view of internal parts of the tong of FIG. 4.
Figure 7:
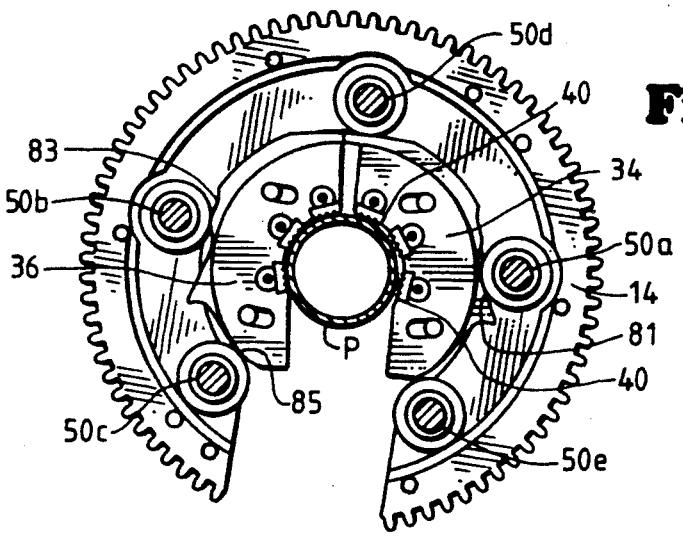
FIG. 7 is another top view of the parts of FIG. 6.
Figure 8:
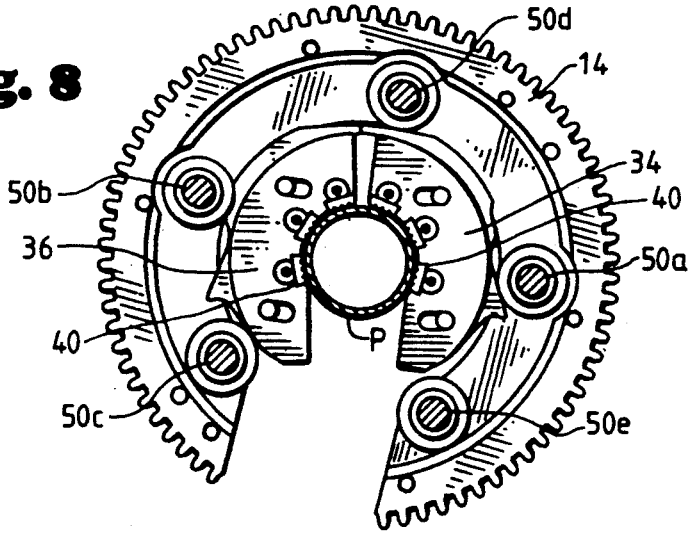
FIG. 8 is another top view of the parts of FIG. 6.
Figure 10:
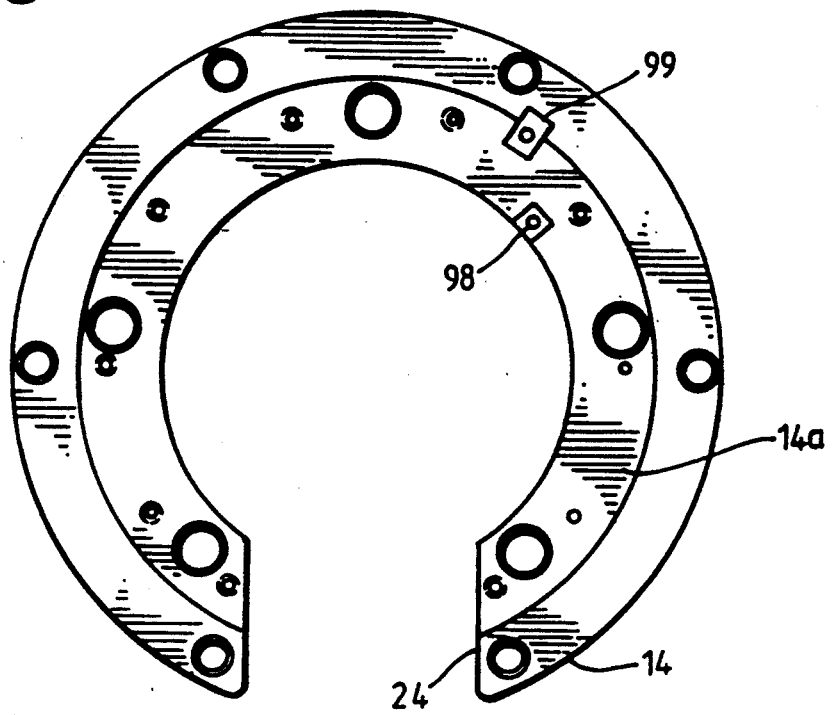
FIG. 10 is a top view of the rotary of the tong of FIG. 4.

FIGS. 6, 7, and 8 illustrate a typical initiation sequence for a makeup operation with the tong 10 of FIG. 4.

FIG. 6 shows the jaws 34 and 36 in a rest position with the jaw roller 50*a* at the rest cam surface 82 of the jaw 34 and the jaw roller 50*b* at the rest cam surface 82 of the jaw 36. The throat 30 of the inner ring and the throat 24 of the rotary 14 are aligned and a pipe P has been introduced into the tong 10. The majority of the jaw dies 40 are not in contact with the outer surface of the pipe P.

As shown in FIG. 7 the rotary 14 has moved counterclockwise, moving the jaws 34 and 36 toward the pipe P by moving the jaw roller 50*a* onto and against the primary camming surface 81 of the jaw 34 and the jaw roller 50*b* toward the plateau cam surface 83 of the jaw 36.

In this intermediate position the jaws are not fully cammed against the pipe and two of the dies 40 of the jaw 34 are not yet in contact with the pipe P. The roller 50*c* has begun to move along the secondary cam surface 85 of the jaw 36. At this point the jaw 36 is contacted or supported by the jaw rollers 50*c* and 50*b* to stabilize the jaw and the jaw 34 is contacted by the rollers 50*d* and 50*a* to stabilize it (inhibit or, preferably prevent unwanted jaw movement or pivoting). As shown in FIG. 8, camming action of the jaw roller 50*a* has moved the jaw 34 into gripping engagement with the pipe P and the jaw roller 50*b* is nested at the plateau cam surface of the jaw 36 (insuring that the pipe P is positioned at a desired location in the tong; i.e. due to the pre-designed geometry of the tong, the jaw, the dies, the cam surfaces, etc., when the roller is positioned as described with respect to the jaw, then the pipe is in a predetermined desired position). Again each jaw has multiple (two or more) contacts with jaw rollers to stabilize the jaw; the jaw 36 contacts the rollers 50*b* and 50*c* and the jaw 34 contacts the rollers 50*d* and 50*a*. It is most preferred that at all times each jaw is contacted by two or more rollers.

A jaw according to this invention, like, e.g., the jaws 34 and 36 described previously, is preferably not pinned or pivotally connected to the inner ring 32 or to any other member and is, in this sense, a "floating" jaw. The jaws preferably rest on, but are not affixed or connected to, the jaw retainer plate or its equivalent. The inner ring 32 (as shown in FIG. 4) rests on a bearing 90 which is secured to a top plate 14*a* of the rotary 14. The top plate 14*a* is secured to a bottom plate 14*b* of the rotary 14. A top brake cover 92 secured to the plate 64 prevents the inner ring 32 from exiting from a top of the tong 10. The bearing 90 also has recesses, not shown, for holding shafts of the jaw rollers 50. A removable pin 94 extends through a hole 96 in the inner ring 32 to contact one of two stop tabs on the rotary 14. Upon relataive movement between the rotary and the inner ring, a stop tab 98 moves to contact the pin 94 and then the inner ring 32 is moved with the rotary 14, but further rotation of the inner ring with respect to the roatary is prevented and thus the jaws are held in a centered rest position so that a tubular member may be moved into or out of the tong; i.e., by predesigning the tong geometry and placting the holes in the inner ring and the stop tabs on the rotary in predetermined locations, the throats of the rotary and of the tong case are so aligned and the jaws are so positioned that pipe movement into and out of the tong is possible. When the tong is operating in the other direction, the removable pin 94 is positioned in a hole 97 in the inner ring 32 for contact by a stop tab 99 on the top plate 14*a* of the rotary 14. The tong is reversible, i.e. can operate in either a breakout or makeup mode, without the pin 94 in place, but this can result in undesirable overcamming past a desired position.

Figure 11:
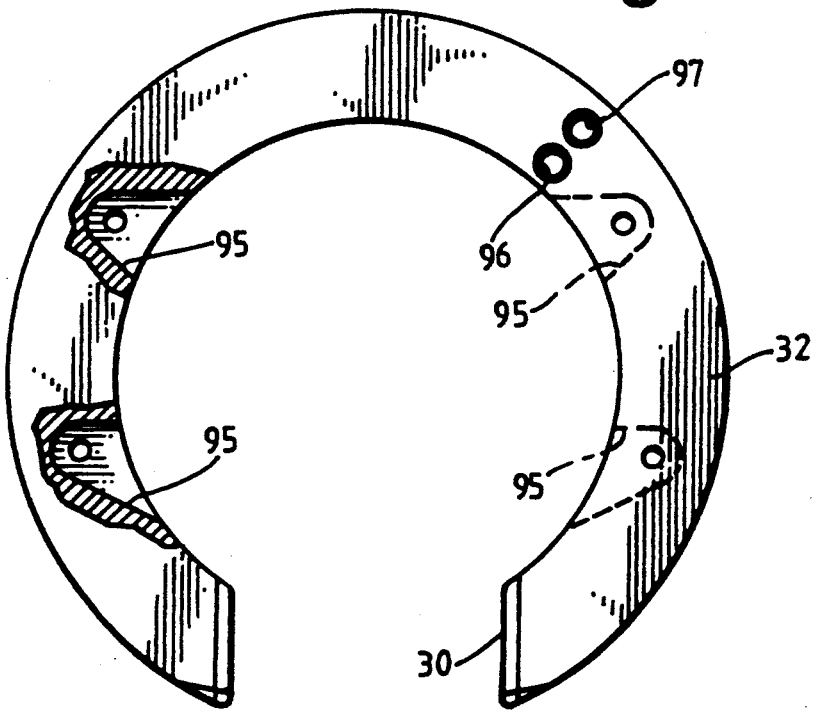
FIG. 11 is top view of the inner ring of the tong of FIG. 4.
Figure 12A:
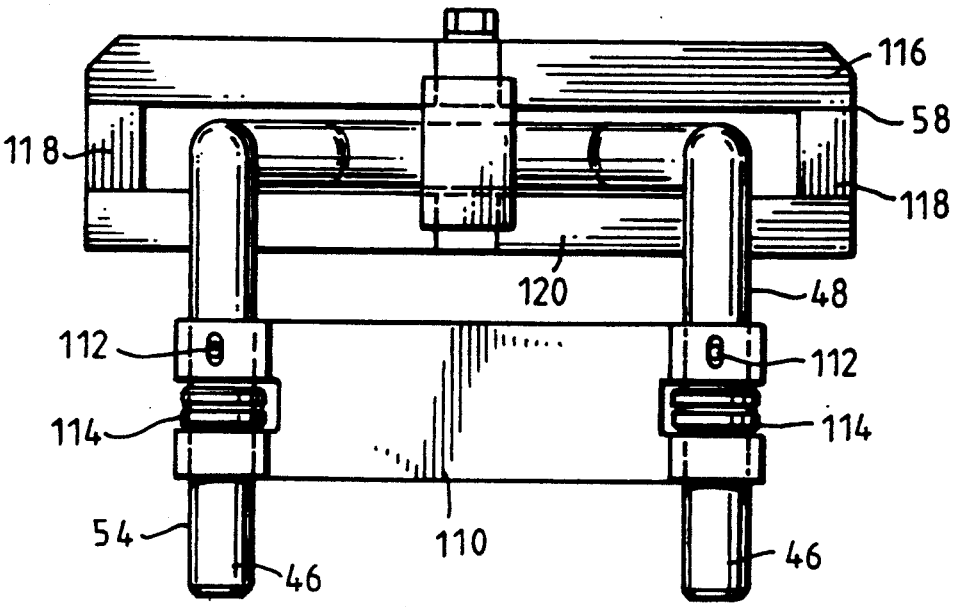
FIG. 12*a* is side view of part of the jaw urging system of the tong of FIG. 4.
Figure 12B:
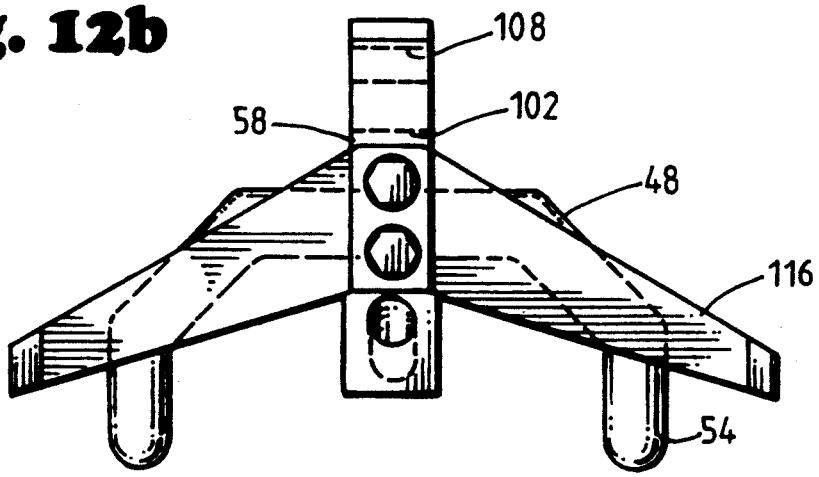
FIG. 12*b* is a top view of the items shown in FIG. 12*a*.

The releasable urging assembly 48 shown in FIGS. 4, 5, 12*a*, and 12*b* is one preferred form of a device for urging the jaws against the jaw rollers in tongs according to this invention. Other embodiments are included within the scope of this invention, for example, but not limited to, a spring interconnected between the inner ring and the jaw will work, or its equivalent. In the assembly 48, since the wishbone member 54 is disposed in an opening 102 and limited movement of the wishbone member 54 in the opening 102 is possible, movement of the jaws with respect to the inner ring is accommodated; i.e., as the jaws move in response to the camming action of the jaw rollers, the wishbone member also moves with respect to the inner ring, although the bracket 58 continues to hold the wishbone member. During such jaw movement, movement of the springs 60 in a horizontal plane is accommodated by the recesses 95 in the inner ring 32 (see FIG. 11). Thus these springs and the projections 46 to which they are attached have some limited freedom of movement when the jaws are moving into or out of contact with a tubular. The pin 56 extends through a hole 108 to allow pivoting movement of the handle 52 and resulting movement of the projections 46 (see arrows A, FIG. 4). A bar 110 pinned with the pins 112 to the projections of the wishbone member provides added stability for the wishbone member. Spools 114 facilitate connection of the springs 60 to the wishbone member 54. The support bracket 58 includes a top cover 116, vertical support bars 118, and a bottom cover 120. Although only one assembly 48 is shown in FIGS. 4 and 5, one such assembly is preferably used with each floating jaw.

Figure 1:
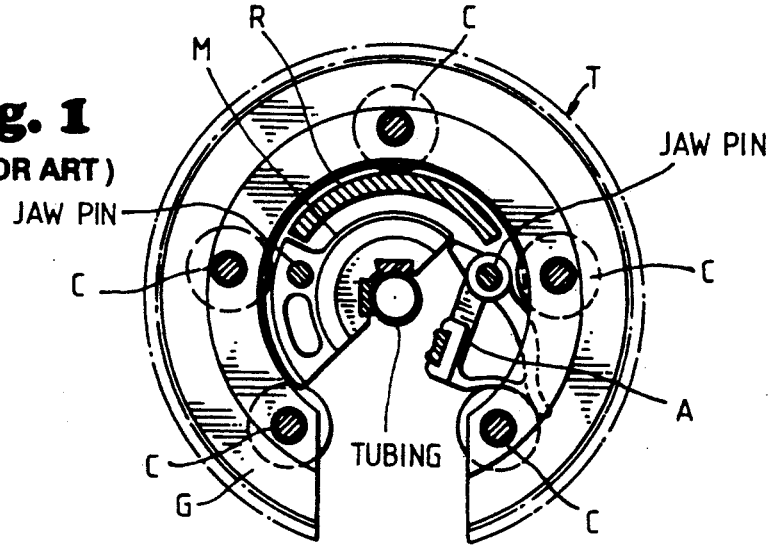
Fig. 1 (PRIOR ART)
FIG. 1 is a top view of a portion of a prior art tong.
Figure 2:
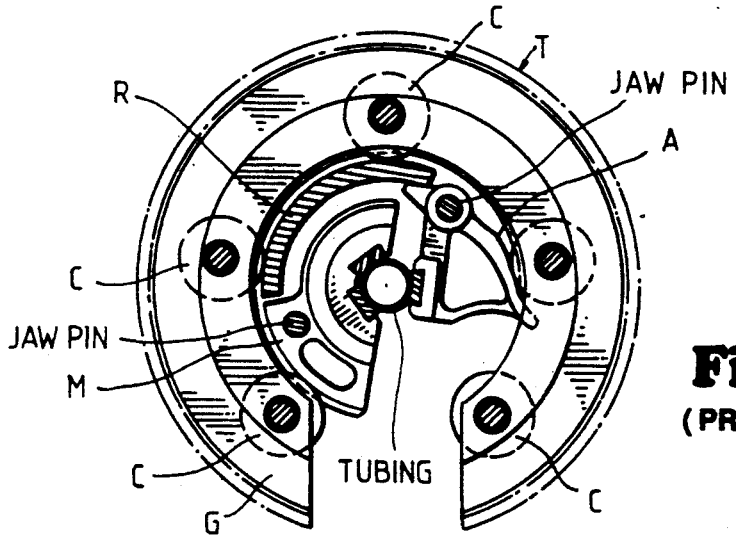
Fig. 2 (PRIOR ART)
FIG. 2 is another top view of the tong of FIG. 1.
Figure 3:
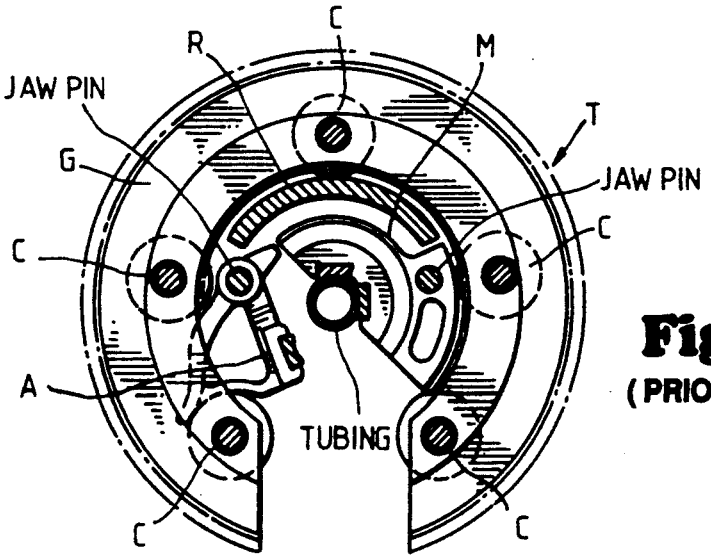
Fig. 3 (PRIOR ART)
FIG. 3 is another top view of the tong of FIG. 1.

In one specific and particular embodiment of the present invention a retrofit kit is provided for converting a prior art tong (e.g. but not limited to the tong of FIG. 1) to a tong with floating jaws as described herein. This is done by removing the jaws of the prior art tong and installing floating jaws and associated structure according to this invention.

This invention includes, among others, the following embodiments:

a tong for rotating a tubular member, the tong having a tong case, a rotary rotatably mounted in the tong case, power means interconnected with the rotary for rotating the rotary, an inner ring on the rotary and movable therewith, at least one floating jaw within the rotary and having a cam surface, jaw roller means rotatably mounted on the rotary for co-action with the cam surface of the jaw to move the jaw into and out of contact with the tubular member to be rotated, and brake means on the tong for inducing slag on the inner ring to initially prevent movement of the inner ring with the rotary;

a tong wherein the cam surface of a floating jaw is a compound cam surface with a primary cam action surface, a rest surface, and a positioning surface for accurate positioning of the jaw so that a tubular member is accuarately positioned within the tong when jaw roller means co-act with the positioning surface;

a tong with a floating jaw with top slot means therein for receiving and holding projection means, the jaw urging means having a holding member movably mounted to the inner ring, the holding member having projection means for removably projecting into the top slot means, and the projection means removable from the top slot means by moving the holding member; and such a tong wherein the floating jaw's top slot means has two top slots and the projection means of the holding member has two projections, one each for extending into each of the top slots, and the jaw urging means has spring means interconnected between the inner ring and the holding member for urging the floating jaw (or jaws if two or more are present) against the jaw roller means;

such tongs wherein there are two or more floating jaws; and such tongs wherein one jaw is movable to properly position the tubular member and the other jaw is movable to grip the tubular member;

such tongs wherein the jaw or jaws rest on a jaw retainer plate secured to the rotary;

such tongs wherein an inner ring rests on bearing means secured to the rotary and the inner ring is positioned partially within the brake means, the brake means including a top cover plate which prevents the inner ring from exiting from a top of the tong;

such tongs wherein the floating jaws each have a tang extension on a side thereof for facilitating contact between the jaw and the jaw roller means;

such tongs wherein there are two floating jaws and the inner ring has indexing holes, the rotary has one stop tab corresponding to each indexing hole, and a pin removably extends through one of the indexing holes for co-action with that hole's corresponding stop tab so that upon such co-action the jaws are positioned to permit movement of the tubular member into or out of the tong;

such tongs wherein the jaw roller means includes a plurality of at least two jaw rollers and each jaw's cam surface always contacts at least two jaw rollers;

such tongs wherein the tong is operable in either a makeup or a breakout direction without removing the jaw or jaws;

releasable urging means for urging a floating tong jaw against jaw roller means, the jaw roller means rotatably mounted to a rotary of a tong, the rotary rotatably mounted in a body of the tong, an inner ring mounted on the rotary and movable therewith, the floating tong jaw having a cam surface for co-action with the jaw roller means to move the floating tong jaw with respect to a tubular member to be rotated by the tong, the releasable urging means having a holding member pivotably mounted to the inner ring and positioned for releasably co-acting with the floating tong jaw so that upon co-action with the floating tong jaw, the holding member urges the floating tong jaw against the jaw roller means;

such releasable urging means wherein the floating tong jaw has top slot means for receiving projection means, the holding member has projection means for removably projecting into the top slot means, and pivoting of the holding member effects removal of the projection means from the top slot means;

such releasable urging means wherein the top slot means has two slots, the projection means has two projections, one projection corresponding to each slot, and spring means interconnected between the inner ring and the holding member urge the floating tong jaw against the jaw foller roller means.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of the invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatêver form its principles may be utilized.

What is claimed is:

1. A tong for rotating a tubular member, the tong comprising a tong case, a rotary rotatably mounted in the tong case, power means interconnected with the rotary for rotating the rotary, an inner ring on the rotary and movable therewith, at least one floating jaw within the rotary and the at least one floating jaw having top slot means therein for receiving and holding projection means and the at least one floating jaw having a cam surface, jaw roller means rotatably secured to and disposed within the rotary for co-action with the cam surface of the at least one floating jaw to move the jaw into and out of contact with the tubular member to be rotated, brake means on the tong for inducing drag to initially prevent movement of the at least one floating jaw, and jaw urging means interconnected between the inner ring and the at least one floating jaw for urging the at least one floating jaw against the jaw roller means, the jaw urging means comprising a holding member movably mounted to the inner ring, the holding member having projection means for removably projecting into the top slot means of the at least one floating jaw, the projection means removable from the top slot means by moving the holding member.

2. The tong of claim 1 wherein the cam surface of the at least one floating jaw comprises a compound cam surface having a primary cam action surface, a rest surface, and a positioning surface for accurate positioning of the at least one floating jaw so that the tubular member is contacted by the jaw and is accurately positioned within the tong when jaw roller means co-act with the positioning surface.

3. The tong of claim 2 wherein the at least one floating jaw is two floating jaws.

4. The tong of claim 1 wherein the at least one floating jaw's top slot means comprises two top slots and the projection means of the holding member comprises two projections, one each for extending into each of the top slots, and the jaw urging means further comprises spring means interconnected between the inner ring and the holding member for urging the at least one floating jaw against the jaw roller means.

5. The tong of claim 1 wherein the at least one floating jaw is two floating jaws.

6. The tong of claim 1 wherein the jaw roller means comprises a plurality of two or more jaw rollers and the at least one floating jaw is two jaws, each jaw having a tang extension on a side thereof for contacting one of the jaw rollers.

7. The tong of claim 1 wherein the at least one floating jaw is removable from the rotary.

8. The tong of claim 7 wherein the at least one floating jaw is two floating jaws.

9. A tong for rotating a tubular member, the tong comprising a tong case, a rotary rotatably mounted in the tong case, a jaw retainer plate secured to the rotary, power means interconnected with the rotary for rotating the rotary, an inner ring on the rotary and movable therewith, at least one floating jaw within the rotary and having a cam surface, the at least one floating jaw resting on the jaw retainer plate, jaw roller means rotatably secured to and disposed within the rotary for co-action with the cam surface of the at least one floating jaw to move the jaw into and out of contact with the tubular member to be rotated, and brake means on the tong for inducing drag to initially prevent movement of the at least one floating jaw.

10. A tong for rotating a tubular member, the tong comprising a tong case, a rotary rotatably mounted in the tong case, power means interconnected with the rotary for rotating the rotary, an inner ring on bearing means secured to the rotary and movable therewith, the inner ring positioned partially within the brake means, at least one floating jaw within the rotary and having a cam surface, jaw roller means rotatably secured to and disposed within the rotary for co-action with the cam surface of the at least one floating jaw to move the jaw into and out of contact with the tubular member to be rotated, and brake means on the tong for inducing drag to initially prevent movement of the at least one floating jaw, the brake means including a top cover plate extending partially over the inner ring and thereby preventing it from exiting from a top of the tong.

11. A tong for rotating a tubular member, the tong comprising a tong case, a rotary rotatably mounted in the tong case, power means interconnected with the rotary for rotating the rotary, an inner ring on the rotary and movable therewith, the inner ring having indexing holes thereon, at least two floating jaws within the rotary and each having a cam surface, jaw roller means rotatably secured to and disposed within the rotary for co-action with the cam surface of one of the at least two floating jaws to move said one of the at least two floating jaws into and out of contact with the tubular member to be rotated, brake means on the tong for inducing drag to initially prevent movement of said one of the at least two floating jaws, the rotary having one stop tab corresponding to each indexing hole, and a pin removably extends through one of the indexing holes for co-action with that hole's corresponding stop tab so that upon such co-action the jaws are positioned to permit movement of the tubular member into or out of the tong.

12. A tong for rotating a tubular member, the tong comprising a tong case, a rotary rotatably mounted in the tong case, power means interconnected with the rotary for rotating the rotary, an inner ring on the rotary and movable therewith, at least one floating jaw within the rotary and having a cam surface, jaw roller means comprising a plurality of at least two jaw rollers rotatably secured to and disposed within the rotary for co-action with the cam surface of the at least one floating jaw to move the jaw into and out of contact with the tubular member to be rotated, the cam surface of the at least one floating jaw always contacting at least two jaw rollers, and brake means on the tong for inducing drag to initially prevent movement of the at least one floating jaw.

13. A tong in combination with a releasable urging means for urging a floating tong jaw against jaw roller means, the jaw roller means rotatably mounted to and disposed within a rotary of the tong, the rotary rotatably mounted in a body of the tong, an inner ring mounted on the rotary and movable therewith, the floating tong jaw having a cam surface for co-action with the jaw roller means to move the floating tong jaw with respect to a tubular member to be rotated by the tong, the releasable urging means comprising a holding member pivotably mounted to the inner ring and positioned for releasably co-acting with the floating tong jaw, the holding member urging the floating tong jaw against the jaw roller means, the floating tong jaw has top slot means for receiving projection means, the holding member has projection means for removably projecting into the top slot means, and pivoting of the holding member effects removal of the projection means from the top slot means.

14. The releasable urging means of claim 13 wherein the top slot means comprises two slots, the projection means comprises two projections, one projection corresponding to each slot, and spring means interconnected between the inner ring and the holding member urge the floating tong jaw against the jaw roller means.

15. A tong for rotating a tubular member, the tong comprising a tong case a rotary rotatably mounted in the tong case power means interconnected with the rotary for rotating the rotary, an inner ring on the rotary and movable therewith, the inner ring resting on bearing means secured to the rotary and the inner ring positioned partially within brake means on the tong, two floating jaws within the rotary each jaw having a cam surface comprising a compound cam surface having a primary cam action surface, a rest surface, and a positioning surface for accurate positioning of the at least one floating jaw so that the tubular member is contacted by the jaw and is accurately positioned within the tong when jaw roller means co-act with the positioning surface, jaw roller means rotatably secured to and disposed within the rotary for co-action with the cam surfaces of the jaws to move the jaws into and out of contact with the tubular member, brake means on the tong for inducing drag to initially prevent movement of the jaws, the brake means including a top cover plate extending partially over the inner ring and preventing it from exiting from within the tong, and releasable jaw urging means interconnected between the inner ring and the jaws for releasably urging the jaws against the jaw roller means.

* * * * *